US007724213B2

(12) United States Patent
Ikeda et al.

(10) Patent No.: US 7,724,213 B2
(45) Date of Patent: May 25, 2010

(54) PLASMA DISPLAY DEVICE

(75) Inventors: Motofumi Ikeda, Chuo (JP); Kazuaki Sakata, Chuo (JP); Masatsugu Onizuka, Chuo (JP)

(73) Assignee: Panasonic Corporation, Osaka (JP)

( * ) Notice: Subject to any disclaimer, the term of this patent is extended or adjusted under 35 U.S.C. 154(b) by 1026 days.

(21) Appl. No.: 11/410,020

(22) Filed: Apr. 25, 2006

(65) Prior Publication Data

US 2006/0279484 A1 Dec. 14, 2006

(30) Foreign Application Priority Data

Jun. 10, 2005 (JP) ..... 2005-171470

(51) Int. Cl.
*G09G 3/28* (2006.01)

(52) U.S. Cl. ..... 345/67; 345/60; 345/68; 315/169.1; 315/169.2; 315/169.3; 315/169.4

(58) Field of Classification Search ..... 345/60, 345/68; 315/169.1–169.4; 445/6
See application file for complete search history.

(56) References Cited

U.S. PATENT DOCUMENTS

2002/0067321 A1* 6/2002 Kanazawa et al. ..... 345/60
2002/0195963 A1* 12/2002 Tokunaga et al. ..... 315/169.3
2003/0214244 A1* 11/2003 Onozawa et al. ..... 315/169.3
2004/0239588 A1* 12/2004 Nagao et al. ..... 345/60
2005/0088376 A1* 4/2005 Inoue et al. ..... 345/60
2005/0116885 A1* 6/2005 Sasaki et al. ..... 345/60
2005/0248511 A1* 11/2005 Sakata et al. ..... 345/67
2005/0264487 A1* 12/2005 Tokunaga et al. ..... 345/63
2006/0290601 A1 12/2006 Ikeda et al.

FOREIGN PATENT DOCUMENTS

JP 2000-338932 12/2000

* cited by examiner

*Primary Examiner*—Henry N Tran
*Assistant Examiner*—Viet Pham
(74) *Attorney, Agent, or Firm*—Drinker Biddle & Reath LLP

(57) ABSTRACT

A plasma display device is provided which can stabilize discharge and improve display quality. In the plasma display device, a rear edge part of a sustain pulse to be applied at the end of a sustain period of each of the subfields is formed of a first section in which a voltage value slowly changes from a peak voltage value of the sustain pulse to a predetermined first voltage value, a second section in which the first voltage value is maintained for a predetermined period, and a third section in which the voltage value slowly changes from the first voltage value to a second voltage value having polarity different from that of the first voltage value.

12 Claims, 13 Drawing Sheets

V3 - V3 CROSS SECTION

#1 W2 - W2 CROSS SECTION

| | SF1 | SF2 | SF3 | SF4 | .... | SF(N-2) | SF(N-1) | SF(N) |
|---|---|---|---|---|---|---|---|---|
| FIRST GRAY LEVEL | ● | | | | | | | |
| SECOND GRAY LEVEL | ○ | ● | | | | | | |
| THIRD GRAY LEVEL | ○ | ○ | ● | | | | | |
| FOURTH GRAY LEVEL | ○ | ○ | ○ | ● | | | | |
| .... | | | | | | | | |
| (N-1)TH GRAY LEVEL | ○ | ○ | ○ | ○ | | ○ | ● | |
| NTH GRAY LEVEL | ○ | ○ | ○ | ○ | .... | ○ | ○ | ● |
| (N+1)TH GRAY LEVEL | ○ | ○ | ○ | ○ | | ○ | ○ | ○ |

V3 - V3 CROSS SECTION

W2 - W2 CROSS SECTION

PLASMA DISPLAY DEVICE

BACKGROUND OF THE INVENTION

1. Field of the Invention

The present invention relates to a plasma display device.

2. Description of the Related Art

At present, a plasma display device having an AC discharge type plasma display panel (hereinafter referred to as PDP), as a thin display device, is known.

The PDP has a plurality of column electrodes and a plurality of row electrode pairs arranged to intersect with the column electrodes via a discharge space. A discharge gas is sealed within the discharge space. At the intersections of the row electrode pairs and the column electrodes, discharge cells, each including the discharge space, are formed which respectively emit red light, green light, and blue light when discharging.

Each of the discharge cells uses discharge phenomenon to emit light, therefore it provides only two states, i.e., a "lighting state" to emit light at a predetermined brightness and an "extinction state". In other words, the discharge cell only expresses two gray scale levels of brightness. Thus, in order to display halftone brightness corresponding to input video signals in the discharge cells described above, gray scale driving using a subfield method is applied (for example, see Japanese Patent Kokai No. 2000-338932).

In the subfield method, a display period for one field is divided into N subfields, and each of the subfields is designed to have a period for continuously performing either light emission or black out in the discharge cell. With this arrangement, each of the discharge cells is controlled to either a light emission state or a black out state during the period assigned to each subfield in accordance with the input video signal. Consequently, various levels of halftone brightness can be displayed at $2^N$ (N denotes the number of subfields) levels (hereinafter referred to as gray scale levels) by the combination of subfields performing light emission within one field display period.

In performing the gray scale driving based on the subfield method, a drive unit (not shown) applies various drive pulses to the PDP to cause various discharges in the discharge cells. For example, in the first subfield, the drive unit firstly applies a reset pulse to the row electrode pairs of the PDP to create a reset discharge in all the discharge cells. On this occasion, the reset discharge uniformly forms a predetermined amount of wall charge in all the discharge cells. Subsequently, the drive unit selectively creates an erase discharge in the discharge cells from one horizontal scanning line (hereinafter referred to as a display line) to another in accordance with the input video signal. On this occasion, in the discharge cell where selective erase discharge occurs, the wall charge remaining in this discharge cell disappears. On the other hand, in the discharge cell where no selective erase discharge occurs, the wall charge formed by the reset discharge remains as it is. Subsequently, the drive unit alternately and simultaneously applies sustain pulses between all the row electrode pairs by the number of sustain pulses corresponding to the first subfield. In response to such application of the sustain pulse, only the discharge cell with the remaining wall charge repeatedly performs sustain discharge only during a period corresponding to the first subfield, and maintains the light emission state due to this sustain discharge.

However, in the PDP, the amount of wall charge formed by various discharges as described above varies due to temperature variation in the panel, the variation in display brightness, aging, etc. Therefore, there is a problem that discharge intensity fluctuates, thereby deteriorating the display quality.

SUMMARY OF THE INVENTION

The invention has been made to solve the problem. An object of the present invention is to provide a plasma display device which can stabilize discharge and improve the display quality.

A plasma display device according to a first aspect of the invention includes a plasma display panel having a plurality of row electrode pairs and a plurality of column electrodes arranged to intersect with the row electrode pairs to form a display cell at each intersection thereof. The plasma display device displays an image by configuring a plurality of subfields within a unit display period of an input video signal, and each of the subfields includes an address period and a sustain period. The plasma display device includes a magnesium oxide layer formed in each of the display cells. The plasma display device also includes addressing means for selectively generating address discharge in each of the display cells in accordance with pixel data based on the video signal in the address period, and sustaining means for repeatedly applying sustain pulses between row electrodes configuring the row electrode pairs in the sustain period. A rear edge part of the sustain pulse applied at the end of the sustain period of each of the subfields is formed by a first section in which a voltage value slowly changes from a peak voltage value of the sustain pulse to a predetermined first voltage value, a second section in which the first voltage value is maintained for a predetermined period, and a third section in which the voltage value slowly changes from the first voltage value to a second voltage value having a polarity different from that of the first voltage value.

DETAILED DESCRIPTION OF THE INVENTION

In a plasma display device according to an embodiment of the invention, a rear edge part of the sustain pulse which is applied to the end of a sustain period of each of the subfields is formed by a first section in which a voltage value slowly changes from a peak voltage value of the sustain pulse to a first voltage value, a second section in which the first voltage value is maintained for a predetermined period, and a third section in which the voltage value slowly changes from the first voltage value to a second voltage value having a polarity different from that of the first voltage value. With this arrangement, spurious discharge at the rear edge part of the sustain pulse can be prevented, and proper setting of the predetermined period and the second voltage value can control the amount of remaining wall charge so as to preferably generate selective discharge in an address period right after the setting.

Figure 1:
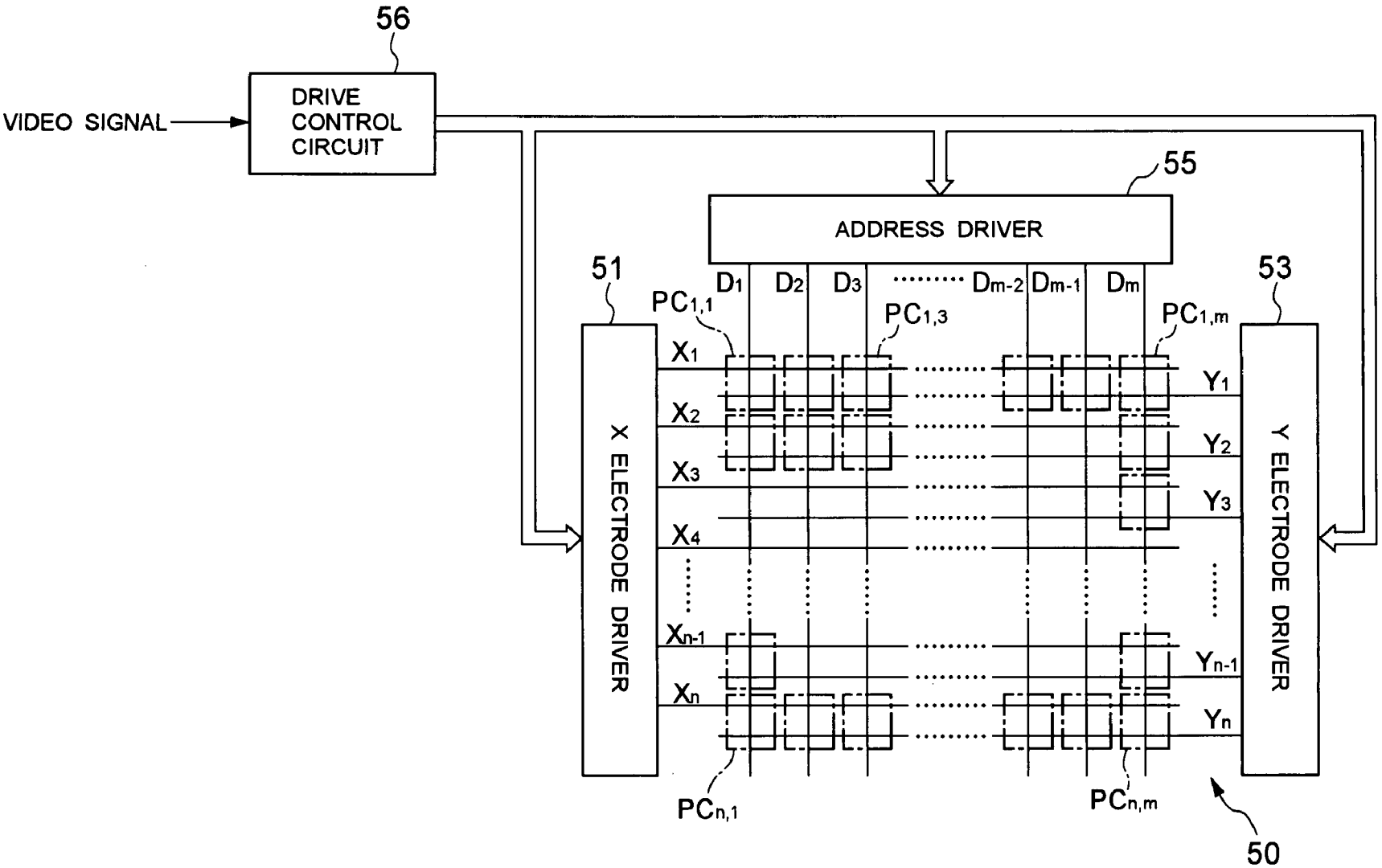
FIG. 1 is a diagram illustrating the schematic configuration of a plasma display device according to an embodiment of the invention.

FIG. 1 is a diagram illustrating a schematic configuration of a plasma display device according to an embodiment of the invention.

As shown in FIG. 1, the plasma display device includes a plasma display panel (PDP) 50, an X electrode driver 51, a Y electrode driver 53, an address driver 55, and a drive control circuit 56.

The PDP 50 is formed with column electrodes D1 to Dm which are arranged to extend in the longitudinal direction (vertical direction) of a two-dimensional display screen, and row electrodes $X_1$ to $X_n$ and row electrodes $Y_1$ to $Y_n$ which are arranged to extend in the transverse direction (horizontal direction). On this occasion, row electrode pairs ($Y_1$, $X_1$), ($Y_2$, $X_2$), ($Y_3$, $X_3$), to ($Y_n$, $X_n$) serve as the first display line to the nth display line of the PDP 50, and each of the row electrode pairs is formed by two electrodes adjacent to each other. At intersections of the display lines and the column electrodes $D_1$ to $D_m$, i.e., areas surrounded by alternate long and short dashed lines in FIG. 1, display cells PC each serving as a pixel are formed. More specifically, in the PDP 50, display cells $PC_{1,1}$ to $PC_{1,m}$ belonging to the first display line, display cells $PC_{2,1}$ to $PC_{2,m}$ belonging to the second display line, . . . , and display cells $PC_{n,1}$ to $PC_{n,m}$ belonging to the nth display line are formed in a matrix pattern.

Figure 2:
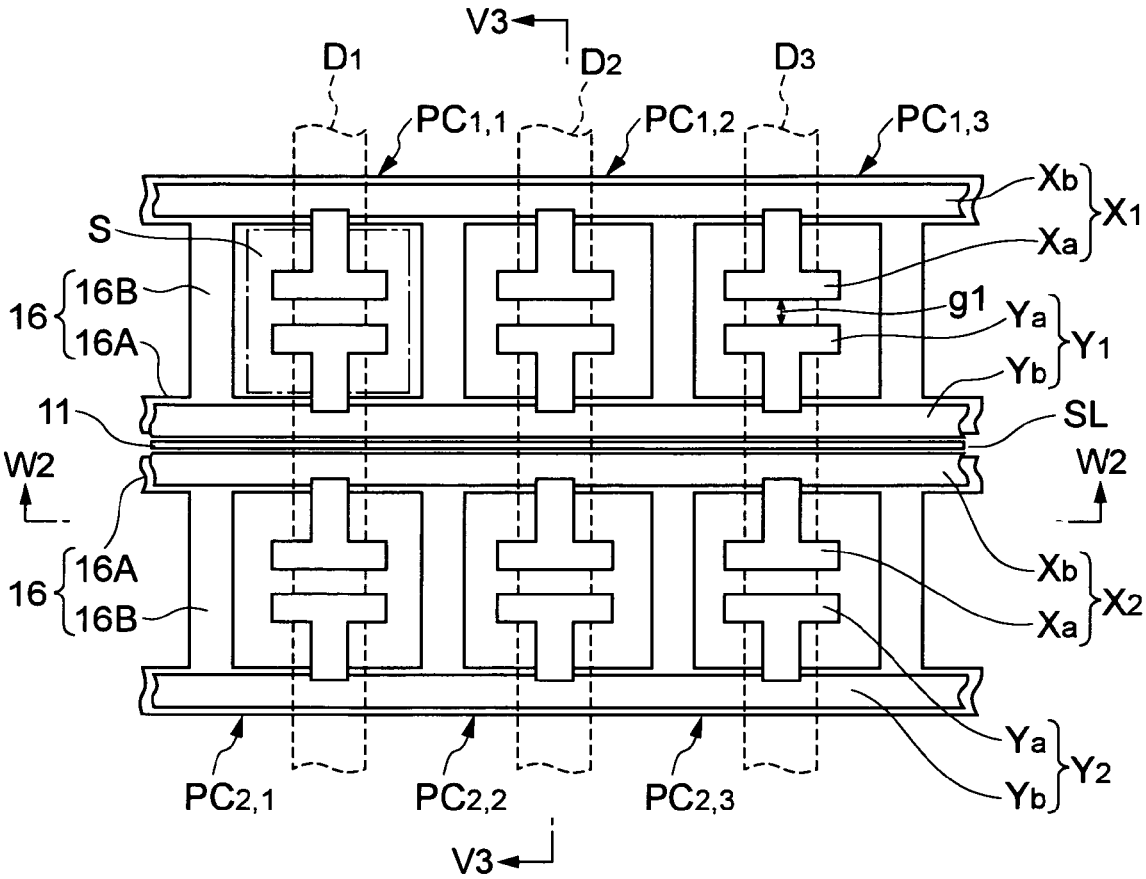
FIG. 2 is a front view schematically illustrating the interior structure of a PDP 50 seen from the display surface side.
Figure 3:
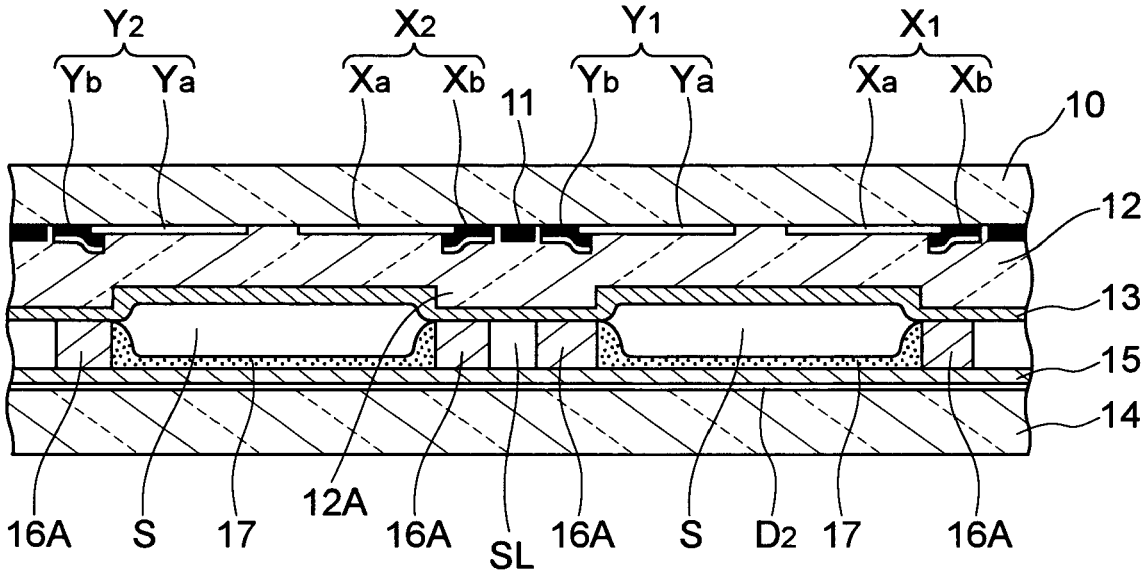
FIG. 3 is a diagram illustrating a cross section along the line V3-V3 shown in FIG. 2.
Figure 4:
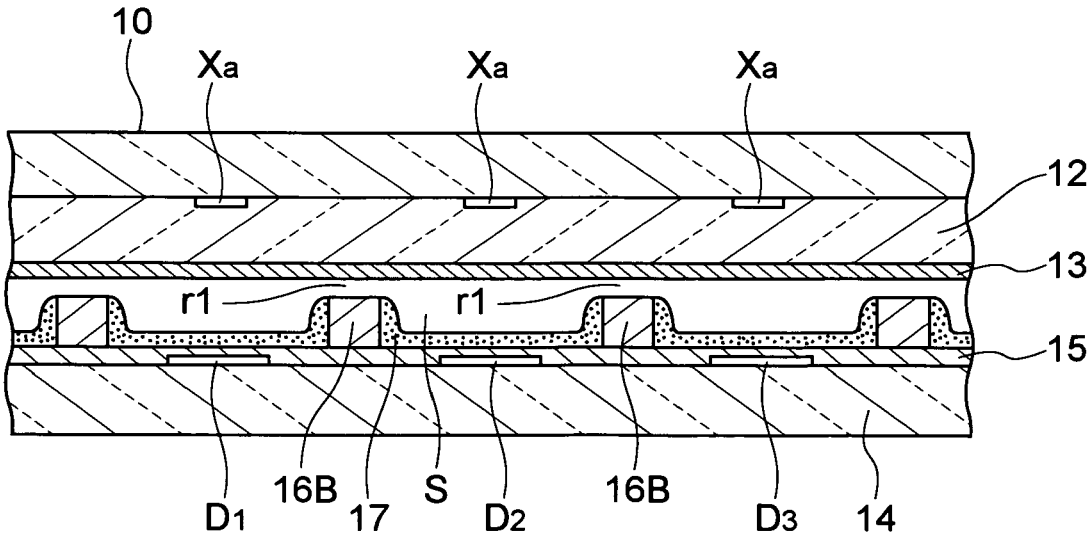
FIG. 4 is a diagram illustrating a cross section along the line W2-W2 shown in FIG. 2.

FIG. 2 is a front view schematically illustrating an interior structure of the PDP 50 seen from the display surface side. It should be noted that FIG. 2 shows a part of the PDP 50 to illustrate intersections of the column electrodes $D_1$ to $D_3$ with the first display line ($Y_1$, $X_1$) and the second display line ($Y_2$, $X_2$). FIG. 3 is a diagram illustrating a cross section of the PDP 50 along the line V3-V3 in FIG. 2, and FIG. 4 is a diagram illustrating a cross section of the PDP 50 along the line W2-W2 in FIG. 2.

As shown in FIG. 2, each of the row electrodes X is configured by a bus electrode Xb extending in the horizontal direction of the two-dimensional display screen, and T-shaped transparent electrodes Xa which are connected to the bus electrode Xb and they are respectively placed at the positions corresponding to the display cells PC. Each of the row electrodes Y is configured by a bus electrode Yb extending in the horizontal direction of the two-dimensional display screen, and T-shaped transparent electrodes Ya which are connected to the bus electrode Yb and they are respectively placed at the positions corresponding to the display cells PC. The transparent electrodes Xa and Ya are formed of transparent conductive film such as ITO, and the bus electrodes Xb and Yb are formed of, for example, metal film. As shown in FIG. 3, the front side of the row electrode X formed of the transparent electrode Xa and the bus electrode Xb and the front side of the row electrode Y formed of the transparent electrode Ya and the bus electrode Yb are attached on the back side of a front transparent substrate 10 serving as the display surface of the PDP 50. In each of the row electrode pairs (X, Y), the transparent electrodes such as Xa of one row electrode side extend towards the other row electrode side, and vice versa. Further, tips of the transparent electrodes Xa and Ya having wider widths are faced with each other through a discharge gap g1 with a predetermined distance. On the back side of the front transparent substrate 10, a light absorbing layer (light shield layer) 11 of black or dark color extending in the horizontal direction of the two-dimensional display screen is formed between a row electrode pair (X1, Y1) and a row electrode pair (X2, Y2) which are adjacent to each other. Furthermore, on the back side of the front transparent substrate 10, a dielectric layer 12 is formed so as to cover the row electrode pairs (X, Y). As shown in FIG. 3, on a back side of the dielectric layer 12, i.e., a side opposite to a side contacting the row electrode pair, an increased or thickened dielectric layer 12A is formed at a position corresponding to an area where the light absorbing layer 11 and the bus electrodes Xb and Yb adjacent to the light absorbing layer 11 are formed. On surfaces of the dielectric layer 12 and the increased dielectric layer 12A, a magnesium oxide layer 13 is formed which includes magnesium oxide crystals that are excited by electron beam irradiation to cause CL (Cathode Luminescence) light emission having a peak in a wavelength ranging from about 200 to about 300 nm. The magnesium oxide crystal contains a vapor-phase-oxidized magnesium crystal obtained by vapor phase oxidization of magnesium vapor which is generated by heating magnesium. The vapor-phase-oxidized magnesium crystal has a polycrystal structure in which cubic crystals are fit into each other as shown in an SEM photography image in FIG. 5A, and a cubic monocrystal structure as shown in an SEM photography image in FIG. 5B, for example. The average particle size is 500 angstrom or more, preferably 2000 angstrom or more on the basis of the measurement using a BET method. As shown in FIG. 6, vapor-phase-oxidized magnesium monocrystals 13B are attached to the surface of the dielectric layer 12 by spraying, electrostatic coating, etc., and thus a magnesium oxide layer 13 is formed. It should be noted that the magnesium oxide layer 13 may be formed by forming a thin magnesium oxide layer on the surface of the dielectric layer 12 by vapor deposition or sputtering, and then by attaching the vapor-phase-oxidized magnesium monocrystals.

On a rear substrate 14 which is arranged in parallel with the front transparent substrate 10, the column electrodes D are formed to extend in a direction orthogonal to the row electrode pairs (X, Y) and arranged at positions respectively facing to the transparent electrodes Xa and Ya of the row electrode pairs (X, Y). On the rear substrate 14, a white column electrode protection layer 15 is further formed to cover the column electrode D. On the column electrode protection layer 15, ribs 16 are formed. The rib 16 is formed to have a ladder shape such that a lateral wall 16A extending in the transverse direction of the two-dimensional display screen is arranged at the position corresponding to the bus electrodes Xb and Yb of the row electrode pairs (X, Y), and that a vertical wall 16B extending in the longitudinal direction of the two-dimensional display screen is arranged at the middle position between the adjacent column electrodes D. It should be noted that the rib 16 of a ladder shape is formed at each of the display lines of the PDP 50 as shown in FIG. 2, and a space SL is provided between the adjacent ribs 16 as shown in FIG. 2. Furthermore, the ladder-shaped rib 16 defines the display cells PC which are separated from each other. Each of the display cells PC includes a discharge space S and the transparent electrodes Xa and Ya. A discharge gas, e.g., xenon gas is sealed in the discharge space S. On a side surface of the lateral wall 16A, a side surface of the vertical wall 16B, and a front surface of the column electrode protection layer 15 in each of the display cells PC, a fluorescent layer 17 is formed so as to cover all the surfaces as shown in FIG. 3. The fluorescent layer 17 is formed of three types of fluorescent materials, i.e., a fluorescent material for red color emission, a fluorescent material for green color emission, and a fluorescent material for blue color emission. As shown in FIG. 3, the discharge space S of the display cell PC are separated from the space SL by contact of the magnesium oxide layer 13 with the lateral wall 16A. On the other hand, as shown in FIG. 4, since the vertical wall 16B is not contacted with the magnesium oxide layer 13, there is a clearance r1 therebetween. More specifically, the discharge spaces S of the display cells PC adjacent to each other in the transverse direction of the two-dimensional display screen communicate with each other through the clearance r1.

Figures 7A, 7B:
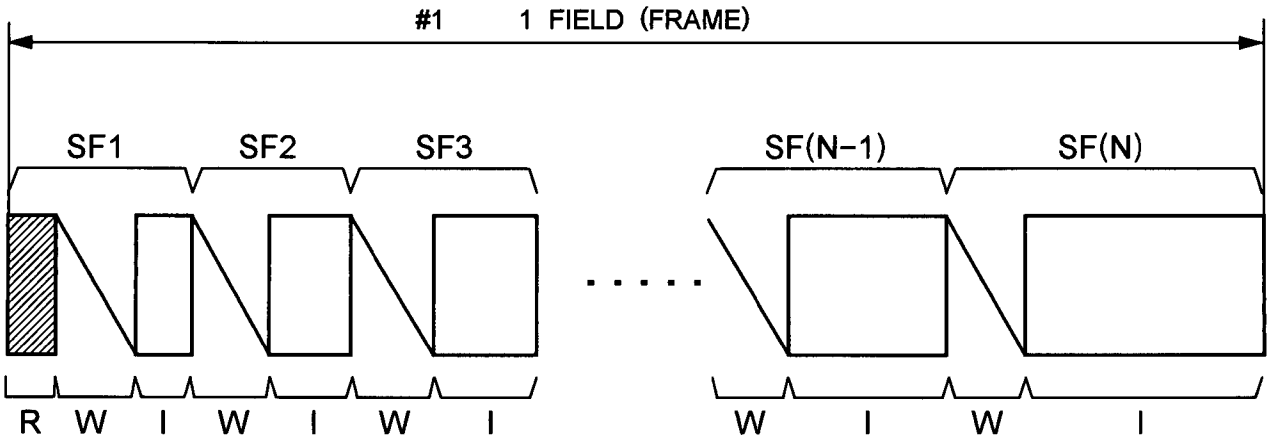
FIG. 7A and FIG. 7B are diagrams illustrating an exemplary light emission drive sequence and an exemplary light emission drive pattern adopted in the plasma display device shown in FIG. 1.

The drive control circuit 56 controls the X electrode driver 51, the Y electrode driver 53, and the address driver 55 in order to gray scale drive each of the display cells PC of the PDP 50 as shown in FIG. 7B in accordance with the light emission drive sequence shown in FIG. 7A based on the subfield method (subframe method). It should be noted that, in the light emission drive sequence shown in FIG. 7A, each of the N subfields SF1 to SF (N) within one field (one frame) of the display period includes an address period W and a sustain period I. A reset period R to be performed right before the address period W is provided only in the first subfield SF1. In the reset period R, all the display cells PC are initialized into the lighting mode state. In the address period W, each of the display cells PC is set to either the lighting mode state or the extinction mode state based on the input video signal. In the sustain period I, only the display cell PC set to the lighting mode state is made to repeatedly emit light by sustain discharge such that the number of sustain discharges of a subfield corresponds to a brightness weight of the subfield. According to the gray scale drive shown in FIG. 7B, each of the display cells PC shifts from the lighting mode state to the extinction mode state only in the address period W of one subfield (denoted by a black circle) in accordance with the brightness level indicated by the input video signal, and after that, this extinction mode state is kept until the subfield SF (N) at the end of the sequence is reached. Therefore, according to the gray scale drive shown in FIG. 7B, the display cell PC is maintained in the lighting mode throughout the continuous subfields (denoted by a white circle) starting from the first subfield SF1. Accordingly, the display cell PC continuously emits light by the sustain discharge during the sustain period I in each of the subfields, and the number of sustain discharges corresponds to the brightness level indicated by the input video signal. Consequently, halftone brightness is viewed in accordance with the number of light emissions by the sustain discharge generated in one field (one frame) of the display period. Thus, according to the gray scale drive shown in FIG. 7B, halftone brightness of (N+1) stages having different brightness levels can be represented by N subfields.

The X electrode driver 51, the Y electrode driver 53, and the address driver 55 generate various drive pulses to perform the driving operation shown in FIGS. 7A and 7B (described later), and supply these pulses to the PDP 50.

Figure 8:
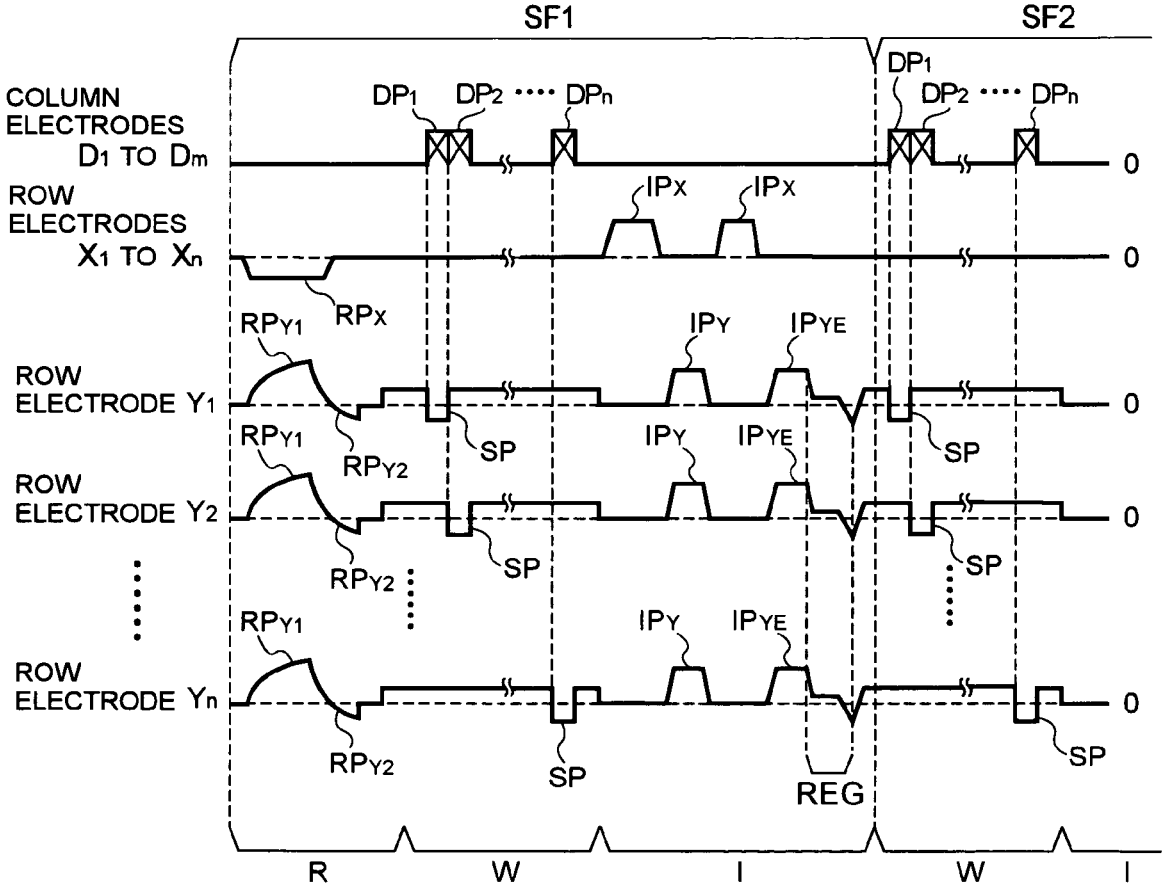
FIG. 8 is a diagram illustrating various drive pulses applied to the PDP 50 and their applying timing.

FIG. 8 is a diagram illustrating the apply times of various drive pulses of two subfields SF1 and SF2 among the subfields SF1 to SF(N). These pulses are applied to the column electrodes D and the row electrodes X and Y of the PDP 50.

In the reset period R, the X electrode driver 51 simultaneously applies reset pulses $RP_X$ of negative polarity as shown in FIG. 8 to the row electrodes $X_1$ to $X_f$. Furthermore, at the same time when the reset pulse $RP_X$ is applied, the Y electrode driver 53 simultaneously applies, to the row electrodes $Y_1$ to $Y_n$, first reset pulses $RP_{Y1}$ of positive polarity each having a pulse waveform such that a voltage value slowly increases to a peak voltage value over time as shown in FIG. 8. Simultaneous application of the first reset pulses $RP_{Y1}$ and the reset pulses $RP_X$ of negative polarity generates first reset discharges between the row electrodes X and Y in all the display cells $PC_{1,1}$ to $PC_{n,m}$. After finishing the first reset discharges, a predetermined amount of wall charge is formed on the surface of the magnesium oxide layer 13 in the discharge space S in each of the display cells PC. More specifically, a so-called wall charge formed state is established in which the electric charge of positive polarity is formed near the row electrodes X on the surface of the magnesium oxide layer 13, and the electric charge of negative polarity is formed near the row electrode Y. After that, as shown in FIG. 8, the Y electrode driver 53 generates second reset pulses $RP_{Y2}$ of negative polarity which have a slow voltage change at the fall time, and simultaneously applies them to all the row electrodes $Y_1$ to $Y_n$. In accordance with application of the second reset pulses $RP_{Y2}$, second reset discharges are generated between the row electrodes X and Y in all the display cells $PC_{1,1}$ to $PC_{n,m}$. By the second reset discharges, the wall charges formed in all the display cells $PC_{1,1}$ to $PC_{n,m}$ disappear. More specifically, in the reset period R all the display cells $PC_{1,1}$ to $PC_{n,m}$ are initialized to the extinction mode state in which no wall charge exists. It should be noted that, since the magnesium oxide layer 13 is formed in the display cell PC, the priming effect due to the reset discharge continues for a long time, and addressing can be made faster.

It should be noted that, in the reset period R, in order to improve the contrast, the first reset pulses $RP_{Y1}$ each having a slow voltage change at the rise time are applied to the row electrodes Y to generate weak first reset discharges between the transparent electrodes Ya and Xa, which are T-shapes.

Next, in the address period W, the address driver 55 generates a pixel data pulse based on an input video signal for setting whether the display cell PC emits light or not in the subfield. For example, the address driver 55 generates a pixel data pulse of high voltage at the display cell PC when the display cell PC is made to emit light, whereas it generates a pixel data pulse of low voltage at the display cell PC when the display cell PC is made not to emit light. Then, the address driver 55 sequentially applies the pixel data pulses to the column electrodes $D_1$ to $D_m$ as pixel data pulse groups $DP_1$, $DP_2$, to $DP_n$ for every display line (m pulses). During this period, the Y electrode driver 53 sequentially applies scanning pulses SP of negative polarity to the row electrodes $Y_1$ to $Y_n$ in synchronization with the timing of the pixel data pulse groups $DP_1$ to $DP_n$. On this occasion, discharge (selective discharge) is generated only in the display cell PC to which both the scanning pulse SP and the pixel data pulse of high voltage are applied. Consequently, a predetermined amount of wall charge is formed on the surfaces of the magnesium oxide layer 13 and the fluorescent layer 17 in the discharge space S of such display cell PC. It should be noted that, since the selective discharge as described above is not generated in the display cell PC to which the pixel data pulse of low voltage is applied even though the scanning pulse SP is applied. This maintains the state of the wall charge formed in the display cell PC until just before.

Specifically, operation of the address period W establishes either the lighting mode state with a predetermined amount of wall charge or the extinction mode state without a predetermined amount of wall charge in the display cell PC based on the input video signal.

Next, in the sustain period I, the X electrode driver 51 and the Y electrode driver 53 alternately and repeatedly apply the sustain pulses $IP_X$ and $IP_Y$ of positive polarity to the row electrodes $X_1$ to $X_n$ and $Y_1$ to $Y_n$. It should be noted that the sustain pulse IP to be applied at the end of the sustain period I in each of the subfields (for example, a sustain pulse $IP_{YE}$ in FIG. 8) has a rear edge part REG having a waveform shown in FIG. 8. Furthermore, in the sustain period I in each of the subfields, the numbers of sustain pulses $IP_X$ and $IP_Y$ to be applied are determined based on the brightness weight of the subfield. In the sustain period I, only the display cell PC with the lighting mode state having a predetermined amount of wall charge performs the sustain discharge whenever the sustain pulses $IP_X$ and $IP_Y$ are applied. Consequently, the fluorescent layer 17 emits light in association with such discharge to form an image on the panel screen.

Figure 5A:
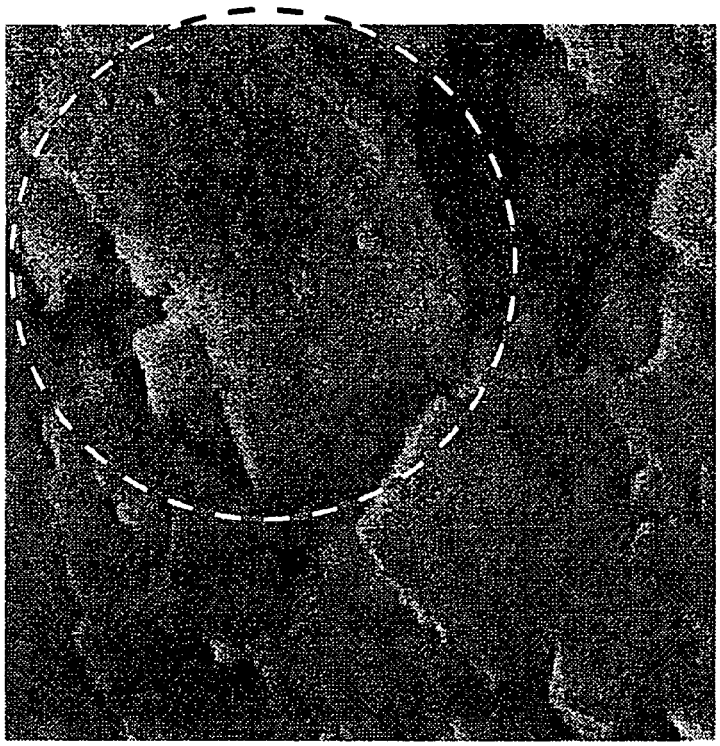
FIG. 5A is a diagram illustrating an exemplary magnesium oxide monocrystal.
Figure 5B:
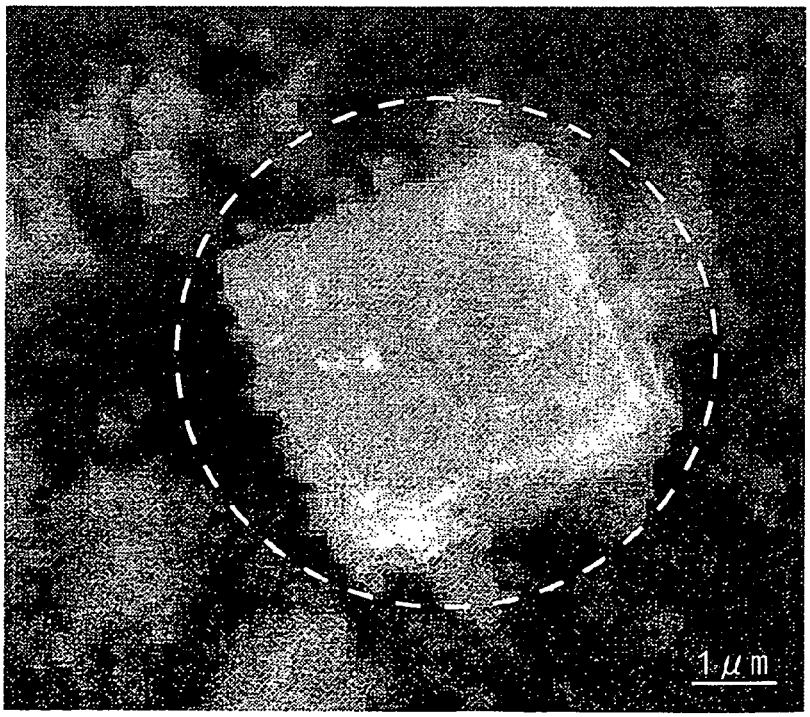
FIG. 5B is a diagram illustrating an exemplary magnesium oxide monocrystal.
Figure 6:
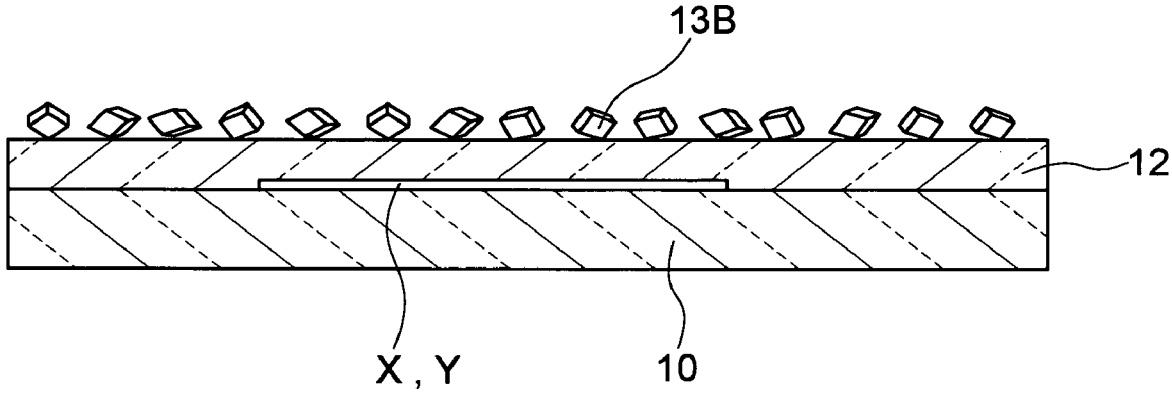
FIG. 6 is a diagram schematically illustrating a form in which vapor-phase-oxidized magnesium monocrystals 13B are attached on the surface of a dielectric layer 12 by spraying, electrostatic coating, etc.
Figure 9:
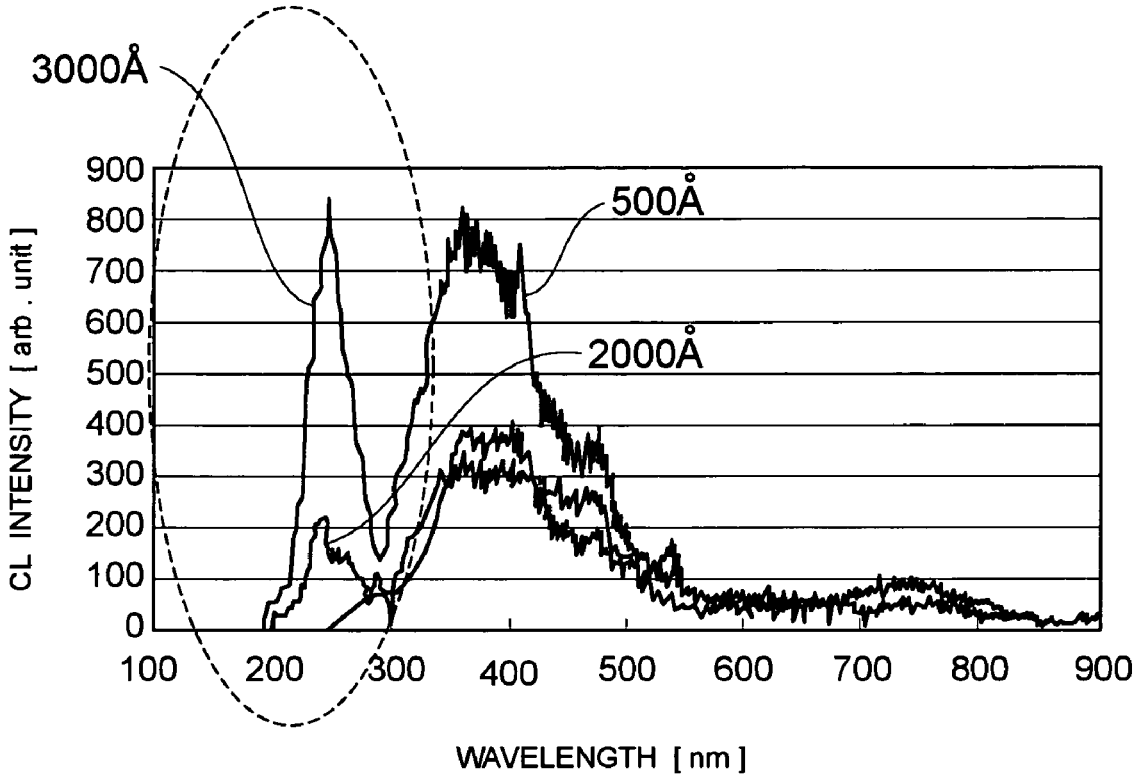
FIG. 9 is a graph illustrating the correspondence between the wavelength and the intensity of CL light emission which is excited when an electron beam is irradiated onto magnesium oxide monocrystals.
Figure 10:
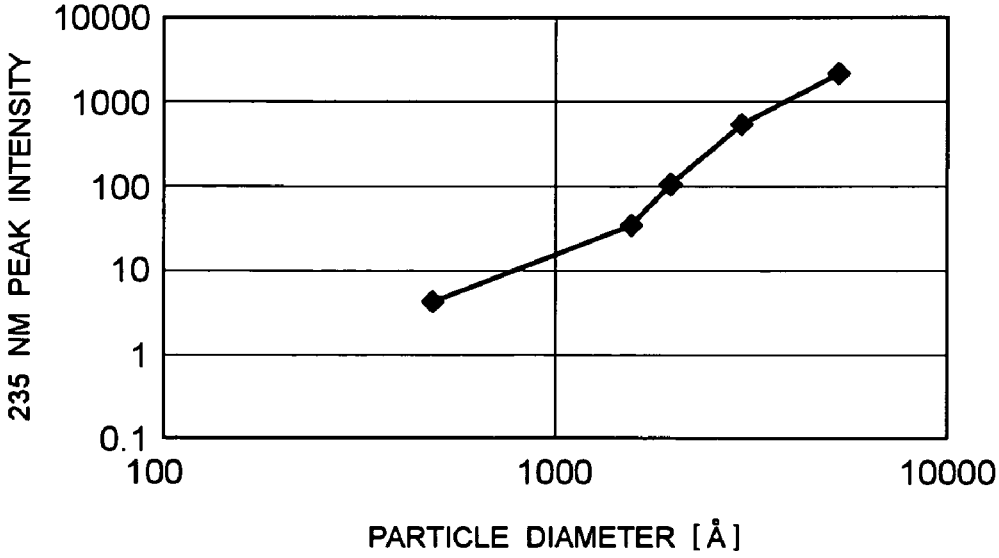
FIG. 10 is a graph illustrating the relationship between the particle size of a magnesium oxide monocrystal and the CL light emission intensity at 235 nm.

The magnesium oxide layer 13 formed in each of the display cells PC contains a vapor-phase-oxidized magnesium monocrystal of a relatively larger shape as shown in FIGS. 5A and 5B. When an electron beam is irradiated onto this monocrystal, CL light emission having a peak in the wavelength ranging from 300 to 400 nm as well as CL light emission having a peak in the wavelength ranging from 200 to 300 nm (particularly near 235 nm in the range from 230 to 250 nm) are generated as shown in FIG. 9. Accordingly, it can be considered that the monocrystal has an energy level corresponding to 235 nm. It should be noted that even though the CL light emission exhibits its peak at 235 nm in FIG. 9, the peak intensity of the CL light emission increases as the particle size of the vapor-phase-oxidized magnesium monocrystal increases as shown in FIG. 10. Specifically, in producing the vapor-phase-oxidized magnesium crystal, when magnesium is heated at a temperature higher than usual, a monocrystal of relatively greater shape having a particle size of 2000 angstrom or more as shown in FIGS. 5A and 5B is formed along with a vapor-phase-oxidized magnesium monocrystal having an average particle size of 500 angstrom. On this occasion, since the temperature to heat magnesium is higher than usual, the length of a flame in reaction of magnesium with oxygen becomes longer. Therefore, temperature difference between the flame and the vicinity becomes greater and thus it can be assumed that a group of vapor-phase-oxidized magnesium monocrystals having larger particle size contains more monocrystals of high energy level corresponding to 200 to 300 nm (particularly 235 nm). As compared with magnesium oxides generated by the other methods, this vapor-phase-oxidized magnesium monocrystal has features such as high purity, fine particle, and less aggregation of particles.

Therefore, since the vapor-phase-oxidized magnesium monocrystal has an energy level corresponding to 235 nm as described above, it can be assumed that the monocrystal captures electrons for a long time (a few milliseconds) and releases these electrons due to application of an electric field at the time of selective discharge so as to quickly obtain initial electrons necessary for the discharge. Therefore, when the magnesium oxide layer 13 as shown in FIG. 3 contains the vapor-phase-oxidized magnesium monocrystal for CL light emission having a peak at 200 to 300 nm by electron irradiation, a sufficient amount of electrons to generate the discharge exists in the discharge space S all the time. This significantly increases discharge probability in the discharge space S.

Figure 11:
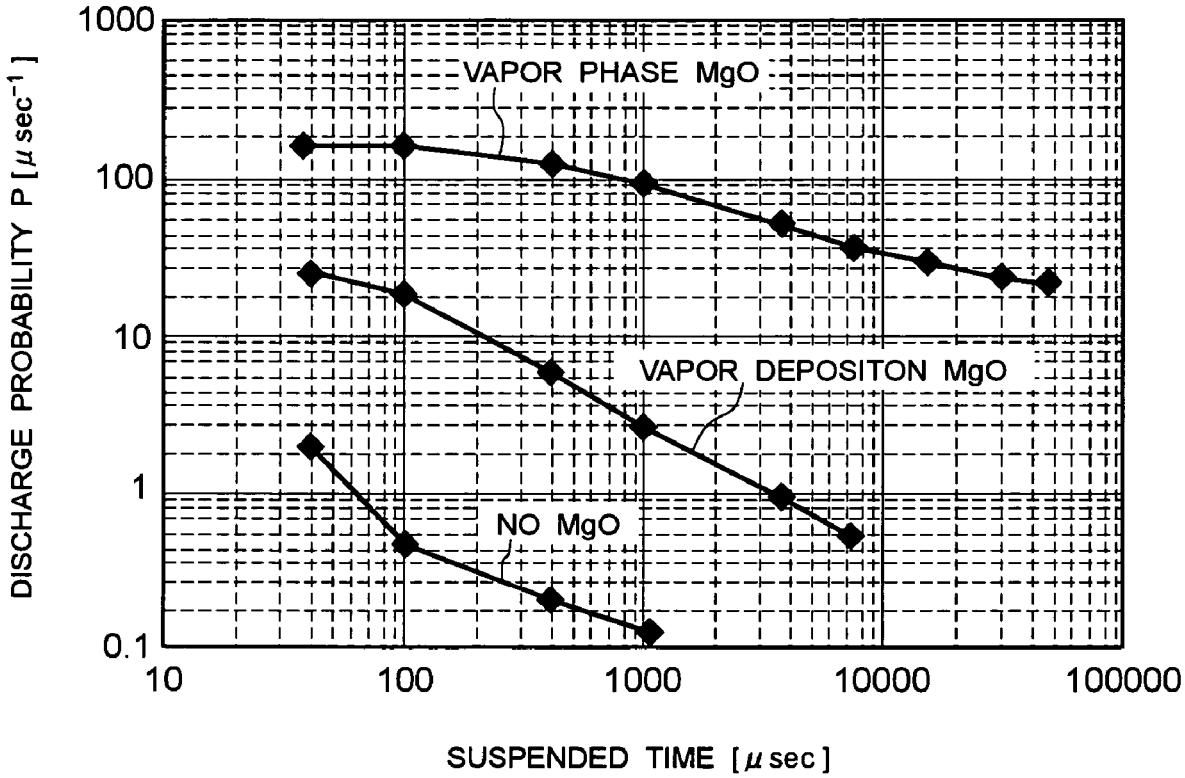
FIG. 11 is a diagram illustrating discharge probabilities when no magnesium oxide layer is provided in a display cell PC, when a magnesium oxide layer is configured by conventional vapor deposition, and when a magnesium oxide layer is provided which includes magnesium oxide monocrystals that excite CL light emission having a peak at 200 to 300 nm by electron beam irradiation.
Figure 12:
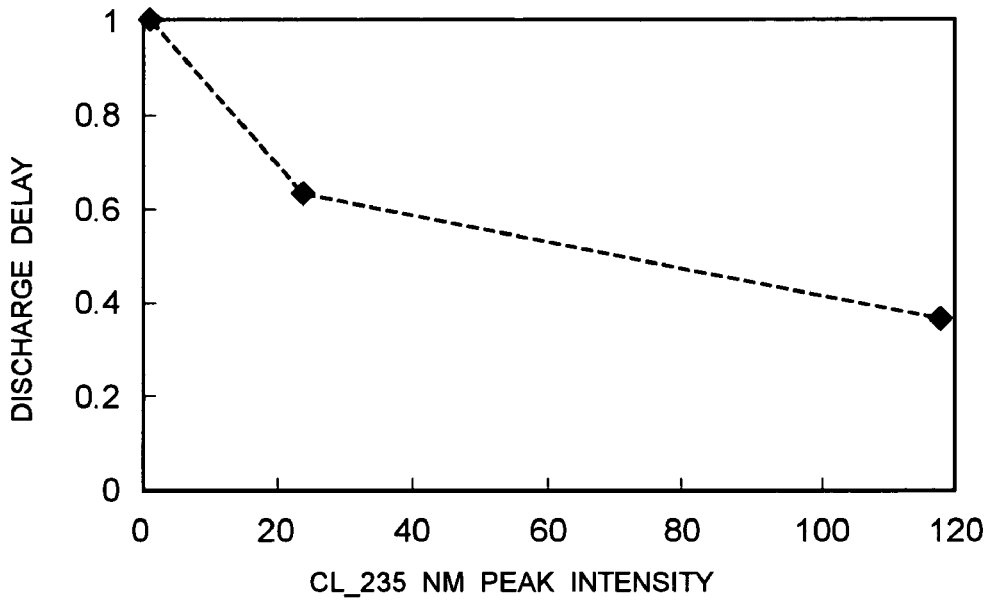
FIG. 12 is a diagram illustrating the correspondence between CL light emission intensity at a 235 nm peak and discharge delay time.
Figure 13:
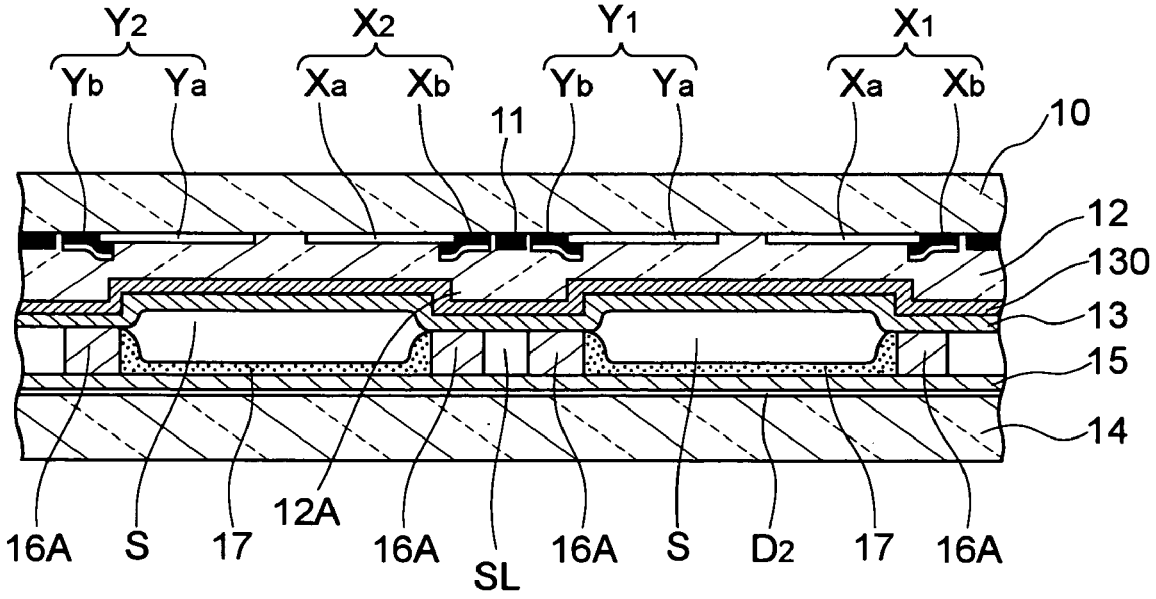
FIG. 13 is a diagram illustrating another exemplary cross section along the line V3-V3 shown in FIG. 2.
Figure 14:
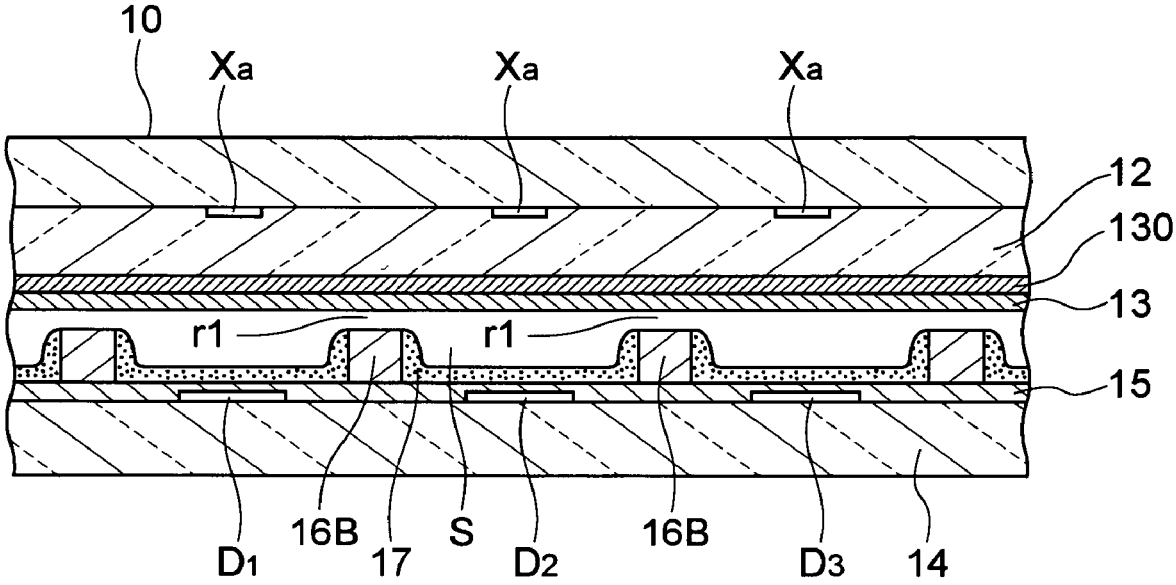
FIG. 14 is a diagram illustrating another exemplary cross section along the line W2-W2 shown in FIG. 2.

FIG. 11 is a diagram illustrating the discharge probabilities when no magnesium oxide layer is provided in the display cell PC, when a magnesium oxide layer is formed by conventional vapor deposition, and when a magnesium oxide layer is provided which contains the vapor-phase-oxidized magnesium monocrystal generating CL light emission having a peak at 200 to 300 nm by electron beam irradiation. In FIG. 11, the abscissa expresses a suspended time for discharge, that is, it expresses a time interval from the time when discharge is generated to the time when the next discharge is generated. As can be understood from the figure, when the magnesium oxide layer 13 containing the vapor-phase-oxidized magnesium monocrystal generating CL light emission having a peak at 200 to 300 nm by electron beam irradiation is provided in each of the display cells PC, the discharge probability is increased as compared with the case in which a magnesium oxide layer is formed by the conventional vapor deposition method. On this occasion, as shown in FIG. 12, the monocrystal having a greater intensity of CL light emission by electron beam irradiation, particularly the CL light emission having a peak at 235 nm can shorten discharge delay that occurs in the discharge space S. It should be noted that a thin magnesium oxide layer 130, which is formed by vapor deposition or sputtering as shown in FIGS. 13 and 14, may be provided between the magnesium oxide layer 13 and the dielectric layer 12.

As described above, when the magnesium oxide layer 13 containing the vapor-phase-oxidized magnesium monocrystal as shown in FIGS. 5A and 5B is provided in the display cell PC, the discharge delay can be shortened, and discharge fluctuations in the display cells PC can be decreased. Since the discharge can be easily generated due to the shortened discharge delay, an unnecessary discharge tends to be generated at the rear edge part (the fall section of pulse voltage) of the drive pulse. Particularly, when a relatively greater discharge is generated in the rear edge part of the sustain pulse IP applied at the end of the sustain period I, the wall charge remaining in the display cell PC is partially erased. Therefore, on this occasion, the selective discharge cannot be correctly generated in the address period W right after the sustain period I.

As a countermeasure, in repeatedly applying the sustain pulses IP in each of the sustain periods I, the Y electrode driver 53 applies the sustain pulse $IP_{YE}$ with the rear edge part REG as shown in FIG. 8 only in the last sustain pulse.

Figure 15:
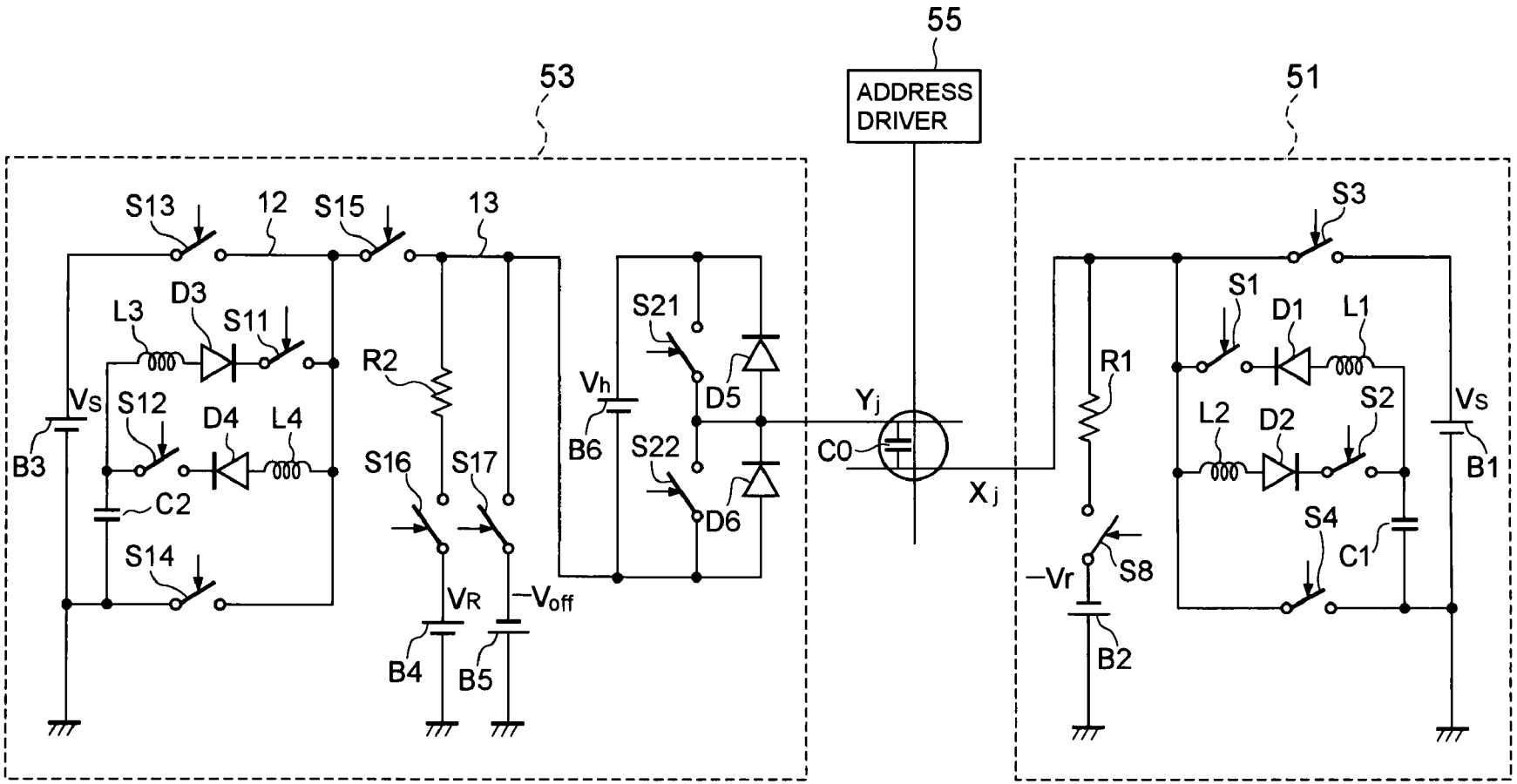
FIG. 15 is a diagram illustrating the internal configurations of an X electrode driver 51 and a Y electrode driver 53.

FIG. 15 is a diagram illustrating the internal configurations of the Y electrode driver 53 and the X electrode driver 51.

In the X electrode driver 51, a direct current power supply B2 generates DC voltage −Vr of negative polarity, and applies it to a switching device S8. The switching device S8 is turned to the ON state in accordance with a switching signal supplied from the drive control circuit 56, and applies voltage −Vr supplied from the direct current power supply B2 to the row electrode X through a resister R1. A direct current power supply B1 generates DC voltage $V_s$ of positive polarity, and applies it to a switching device S3. The switching device S3 is turned to the ON state in accordance with a switching signal supplied from the drive control circuit 56, and applies the voltage $V_s$ supplied from the direct current power supply B1 to the row electrode X. A switching device S1 is turned to the ON state in accordance with a switching signal supplied from the drive control circuit 56, and applies the voltage at one of the electrode terminals of a condenser C1 to the row electrode X through a coil L1 and a diode D1. A switching device S2 is turned to the ON state in accordance with a switching signal supplied from the drive control circuit 56, and applies the voltage on the row electrodes X to one of the electrode terminals of the condenser C1 through a coil L2 and a diode D2. A switching device S4 is turned to the ON state in accordance with a switching signal supplied from the drive control circuit 56, and grounds the row electrodes X.

On the other hand, in the Y electrode driver 53, a direct current power supply B3 generates DC voltage $V_s$ of positive polarity, and applies it to a switching device S13. The switching device S13 is turned to the ON state in accordance with a switching signal supplied from the drive control circuit 56, and applies the voltage $V_s$ supplied from the direct current power supply B3 to a line 12. A switching device S11 is turned to the ON state in accordance with a switching signal supplied from the drive control circuit 56, and applies the voltage at one of the electrode terminals of a condenser C2 to the line 12 through a coil L3 and a diode D3. A switching device S2 is turned to the ON state in accordance with a switching signal supplied from the drive control circuit 56, and applies the voltage on the line 12 to one of the electrode terminals of the condenser C2 through a coil L4 and a diode D4. A switching device S1 is turned to the ON state in accordance with a switching signal supplied from the drive control circuit 56, and grounds the line 12. A switching device 15 is turned to the ON state in accordance with a switching signal supplied from the drive control circuit 56, and connects the line 12 to a line 13. A direct current power supply B4 generates DC voltage $V_R$ of positive polarity, and applies it to a switching device S16. The switching device S16 is turned to the ON state in accordance with a switching signal supplied from the drive control circuit 56, and applies the voltage $V_R$ supplied from the direct current power supply B4 to the line 13 through a resister R2. A direct current power supply B5 generates DC voltage $-V_{off}$ of negative polarity, and applies it to a switching device S17. The switching device S17 is turned to the ON state in accordance with a switching signal supplied from the drive control circuit 56, and applies the voltage $-V_{off}$ of negative polarity supplied from the direct current power supply B5 to the line 13. A direct current power supply B6 generates DC voltage $V_h$. The negative electrode terminal of the direct current power supply B6 is connected to the anode electrode of the line 13, a switching device S22 and the diode D6 respectively, and the positive electrode terminal thereof is connected to the cathode electrodes of a switching device S21 and a diode D5 respectively. The switching device S21 is turned to the ON state in accordance with a switching signal supplied from the drive control circuit 56, short-circuits between the anode electrode and the cathode electrode of the diode D5, and applies the voltage at the positive electrode terminal of the direct current power supply B6 to the row electrodes Y. The switching device S22 is turned to the ON state in accordance with a switching signal supplied from the drive control circuit 56, short-circuits between the anode electrode and the cathode electrode of the diode D6, and applies the voltage at the negative electrode terminal of the direct current power supply B6 to the row electrodes Y.

Hereinafter, the operation of generating various drive pulses by the configuration shown in FIG. 15 will be described.

First, in the reset period R, the drive control circuit 56 sets the switching device S8 of the X electrode driver 51 to the ON state, and the switching device S16 of the Y electrode driver 53 to the ON state for a predetermined period. Thus, as shown in FIG. 8, the reset pulses $RP_X$ are generated on the row electrodes X, and the first reset pulses $RP_{Y1}$ are generated on the row electrodes Y.

Subsequently, in the address period W, the drive control circuit 56 sets one of the switching devices S21 and S22 of the Y electrode driver 53 to the ON state, and the other to the OFF state. On this occasion, during the ON state of the switching device S22, the scanning pulses SP of negative polarity as shown in FIG. 8 are generated on the row electrodes Y.

In the sustain period I, the drive control circuit 56 fixes the switching devices S16 and S22 of the Y electrode driver 53 to the OFF state, and the switching devices S15 and S21 of the Y electrode driver 53 to the ON state. During this period, the drive control circuit 56 repeatedly implements the switching sequence such that the switching devices S1 to S3 of the X electrode driver 51 are alternately and sequentially set to the ON state in the order of S1, S3 and S2. Thus, the sustain pulses $IP_X$ of positive polarity as shown in FIG. 8 are repeatedly generated on the row electrodes X. Furthermore, the drive control circuit 56 repeatedly implements the switching sequence such that the switching devices S11 to S13 of the Y electrode driver 53 are alternately and sequentially set to the ON state in the order of S11, S13 and S12. Thus, the sustain pulses $IP_Y$ of positive polarity as shown in FIG. 8 are repeatedly generated on the row electrodes Y.

Figure 16:
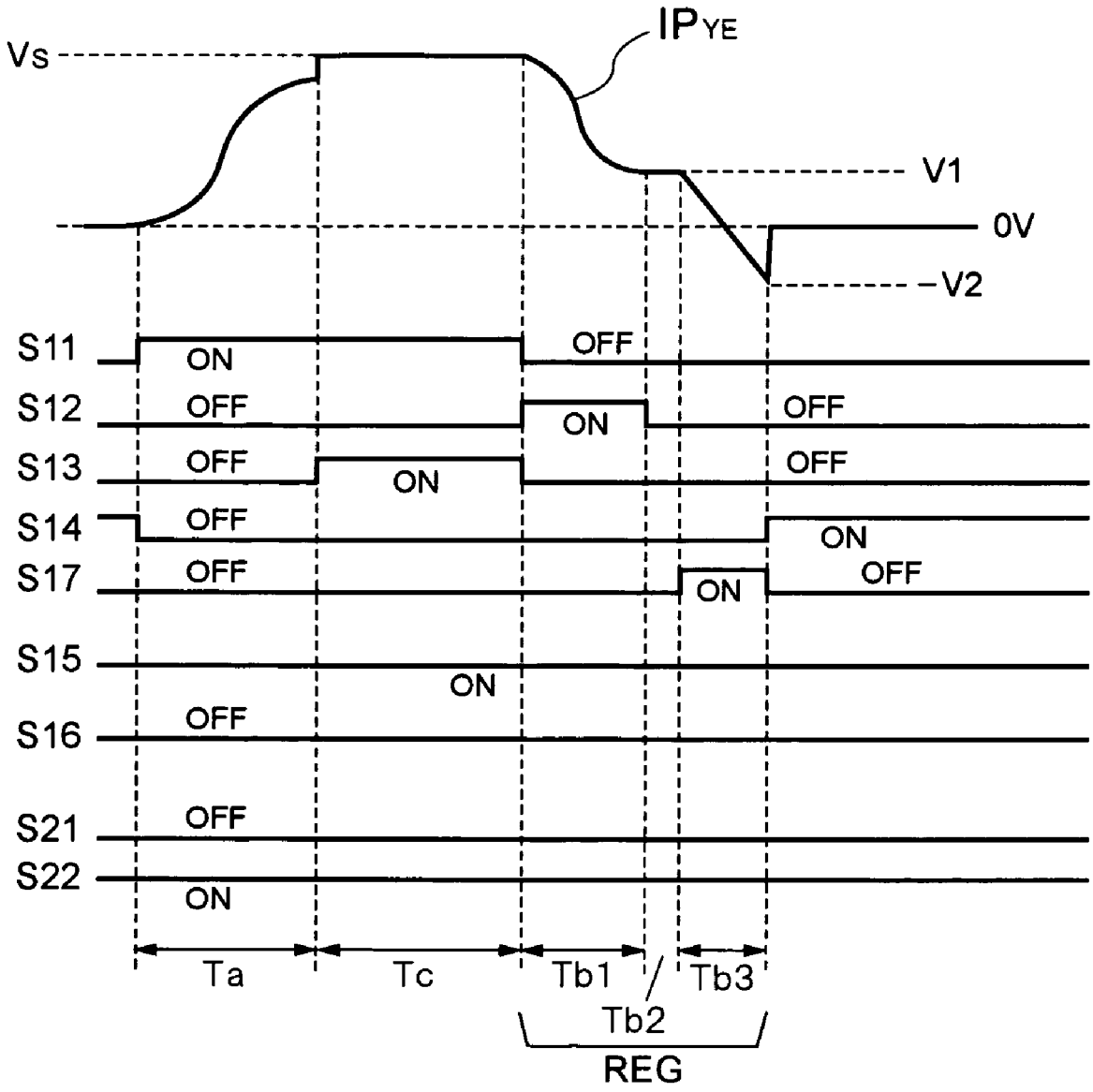
FIG. 16 is a diagram illustrating a switching sequence adopted in generating a sustain pulse $IP_{YE}$.

However, only when the sustain pulse $IP_{YE}$, to be applied at the end, is generated, the drive control circuit 56 performs drive control over the Y electrode driver 53 based on the switching sequence shown in FIG. 16.

In FIG. 16, the drive control circuit 56 first switches the switching device S11 from the OFF state to the ON state, switches the switching device S14 from the ON state to the OFF state, and then switches the switching device S13 from the OFF state to the ON state after a predetermined period Ta has elapsed. Then, the current associated with the electric charge stored in the condenser C2 flows into the display cells PC through the coil 13, the diode D3, the switching device S11, S15 and S21, and the row electrode Y. Thus, the voltage on the row electrode Y slowly rises as shown in FIG. 16. At this time, the voltage rise section is the front edge part of the sustain pulse $IP_{YE}$. Then, when the switching device S13 is switched from the OFF state to the ON state, the voltage $V_s$ at the positive electrode terminal of the direct current power supply B3 is applied to the row electrode Y through the switching devices S13, S15 and S22, and the voltage on the row electrode Y is fixed to $V_s$. The voltage Vs is the peak voltage of the sustain pulse $IP_{YE}$. The drive control circuit 56 maintains the ON state of the switching device S13 for a predetermined period Tc, and then switches it to the OFF state. It further switches the switching device S11 to the OFF state, and the switching device S12 to the ON state. Then, the current associated with the electric charge stored in a load capacitance $C_0$ between the row electrodes X and Y flows into the condenser C2 through the row electrode Y, the switching devices S22 and S15, the coil L4, the diode D4, and the switching device S12. On this occasion, by the charge operation of the condenser C2, the voltage on the row electrode Y slowly drops as shown in FIG. 16.

The drive control circuit 56 maintains the ON state of the switching device S12 for a predetermined period $T_{b1}$, and then switches it to the OFF state. It further switches the switching device S17 to the ON state after a predetermined period $T_{b2}$ has elapsed. Consequently, since all the switching devices S11 to S14 and S17 are in the OFF state for a predetermined period $T_{b2}$, the row electrode Y is turned to the high impedance state. Therefore, the voltage on the row electrode Y is maintained for this predetermined period $T_{b2}$ at voltage V1 which is the voltage right before the switching device S12 is switched from the ON state to the OFF state. On this occasion, since the voltage drop is temporarily suspended, spurious discharge which occurs at the voltage drop can be suppressed.

Then, after this predetermined period $T_{b2}$ has elapsed, the drive control circuit 56 sets the switching device S17 to the ON state for a predetermined period $T_{b3}$. Then, since the voltage $-V_{off}$ at the negative electrode terminal of the direct current power supply B5 is applied to the row electrode Y through the switching device S22, the voltage on the row electrodes Y slowly drops, and reaches negative voltage −V2 (for example, voltage $-V_{off}$). After that, the drive control circuit 56 sets the switching device S14 to the ON state. Consequently, the voltage on the row electrodes Y reaches the ground potential, that is, 0 volt, from the negative voltage −V2. On this occasion, as shown in FIG. 16, the voltage on the row electrodes Y drops for the predetermined periods $T_{b1}$ to $T_{b3}$ to form the rear edge part REG of the sustain pulse $IP_{YE}$. It should be noted that, in the rear edge part REG like this, the voltage −V2 is set to a smaller value as the predetermined period $T_{b2}$ becomes greater.

As described above, the section ($T_{b2}$) is provided in the rear edge part REG of the sustain pulse $IP_{YE}$ such that the voltage value is maintained at a predetermined voltage V1 for a predetermined period after the voltage is slowly changed from a peak voltage value to the voltage V1, thereby preventing spurious discharge at the rear edge part of the sustain pulse. Furthermore, the section ($T_{b3}$) is provided in the rear edge part REG such that the voltage is slowly changed from the voltage V1 to the predetermined voltage −V2 having polarity different from that of the voltage V1. On this occasion, the predetermined period $T_{b2}$ and the voltage −V2 are properly set, thereby allowing control of the amount of remaining wall charge to the amount that can preferably generate selective discharge in the address period W right after that period. Thus, by the sustain pulse $IP_{YE}$ described above, the margin for selective discharge in the address period implemented right after the period can be increased.

As described above, according to the plasma display device of the invention, it becomes possible to stabilize the discharge and to improve the display quality.

This application is based on a Japanese Patent Application No. 2005-171470 which is herein incorporated by reference.

What is claimed is:

1. A plasma display device including a plasma display panel having a plurality of row electrode pairs and a plurality of column electrodes arranged to intersect with the row electrode pairs so as to form a display cell at each intersection thereof, the plasma display device displaying an image by configuring a plurality of subfields within a unit display period of an input video signal, each of the subfields including an address period and a sustain period, the plasma display device comprising:

a magnesium oxide layer formed in each of the display cells;

addressing means for selectively generating address discharge in each of the display cells in accordance with pixel data based on the video signal in the address period; and sustaining means for repeatedly applying sustain pulses between row electrodes configuring the row electrode pairs in the sustain period, wherein a rear edge part of the sustain pulse applied at the end of the sustain period of each of the subfields is formed by a first section in which a voltage value slowly changes from a peak voltage value of the sustain pulse to a predetermined first voltage value, a second section in which the first voltage value is maintained for a predetermined period, and a third section in which the voltage value slowly changes from the first voltage value to a second voltage value having a polarity different from that of the first voltage value.

2. The plasma display device according to claim 1, wherein the sustaining means sets the row electrode to a high impedance state for the predetermined period in the second section to maintain the row electrode in the first voltage value.

3. The plasma display device according to claim 1, wherein the first voltage value is smaller than the peak voltage value and greater than ground potential.

4. The plasma display device according to claim 1, wherein the second voltage becomes smaller as the predetermined period becomes greater.

5. The plasma display device according to claim 1 further comprising reset means for forming a wall charge in all the display cells right before the address period of a first subfield of the unit display period, wherein the addressing means erases the wall charge in the address period in any one of the subfields in the unit display period in accordance with the input video signal at each of the display cells, and the sustaining means causes light emission by sustain discharge only in the display cell in which the wall charge is formed by the application of the sustain pulse.

6. The plasma display device according to claim 1, wherein the magnesium oxide layer contains a magnesium oxide monocrystal which is generated by vapor phase oxidization of magnesium vapor generated when magnesium is heated.

7. The plasma display device according to claim 1, wherein the magnesium oxide layer contains a magnesium oxide monocrystal having a particle size of at least 2000 angstrom.

8. The plasma display device according to claim 1, wherein the magnesium oxide layer contains a magnesium oxide monocrystal excited by electron beam irradiation for cathode luminescence light emission and creating a cathode luminescence light emission having a peak in a wavelength ranging from about 200 to about 300 nm.

9. The plasma display device according to claim 1, wherein the magnesium oxide layer contains a magnesium oxide monocrystal excited by electron beam irradiation for cathode luminescence light emission and creating a cathode luminescence light emission having a peak in a wavelength ranging from about 230 to about 250 nm.

10. The plasma display device according to claim 1, wherein each row electrode forming each of the row electrode pairs includes a bus electrode and a T-shaped transparent electrode connected to the bus electrode.

11. A plasma display device including a plasma display panel having a plurality of row electrode pairs and a plurality of column electrodes arranged to intersect with the row electrode pairs so as to form a display cell at each intersection thereof, the plasma display device displaying an image by configuring a plurality of subfields within a unit display period of an input video signal, each of the subfields including an address period and a sustain period, the plasma display device comprising:

a magnesium oxide layer formed in each of the display cells;

an addressing driver for selectively generating address discharge in each of the display cells in accordance with pixel data based on the video signal in the address period; and a sustain driver for repeatedly applying sustain pulses between row electrodes configuring the row electrode pairs in the sustain period, wherein a rear edge part of the sustain pulse applied at the end of the sustain period of each of the subfields is formed by a first section in which a voltage value slowly changes from a peak voltage value of the sustain pulse to a predetermined first voltage value, a second section in which the first voltage value is maintained for a predetermined period, and a third section in which the voltage value slowly changes from the first voltage value to a second voltage value having a polarity different from that of the first voltage value.

12. A method for driving a plasma display device including a plurality of row electrode pairs and a plurality of column electrodes arranged to intersect with the row electrode pairs so as to form a display cell at each intersection thereof, the plasma display device displaying an image by configuring a plurality of subfields within a unit display period of an input video signal, each of the subfields including an address period and a sustain period, the method comprising the steps of:

slowly changing a voltage value of a rear edge part of the sustain pulse applied at the end of the sustain period of each of the subfields from a peak voltage value of the sustain pulse to a predetermined first voltage value;

maintaining the first voltage value for a predetermined period; and slowly changing the voltage value from the first voltage value to a second voltage value having polarity different from that of the first voltage value.

* * * * *